US005249306A

United States Patent [19]

Morris

[11] Patent Number: 5,249,306

[45] Date of Patent: Oct. 5, 1993

[54] SELF-DEFENSE PRACTICE ASSEMBLY

[75] Inventor: Mark Morris, Boston, Mass.

[73] Assignee: Al Potash, Thousand Oaks, Calif.

[21] Appl. No.: 572,648

[22] Filed: Aug. 27, 1990

[51] Int. Cl.[5] ..... A41D 13/00

[52] U.S. Cl. ..... 2/2; 602/72

[58] Field of Search ..... 2/2, 410, 411, 425, 2/422, 44, 45; 128/846, 870, 874; 602/60, 61, 67, 72

[56] References Cited

U.S. PATENT DOCUMENTS

| | | | |
|---|---|---|---|
| D. 238,118 | 12/1975 | Rhee | D2/232 |
| 1,105,569 | 7/1914 | Lacrotte | 2/2 |
| 1,532,037 | 3/1925 | Cahill | 2/2 |
| 1,691,658 | 11/1928 | Kennedy | 2/2 |
| 1,720,439 | 7/1929 | Richardson | 2/2 |
| 2,108,336 | 2/1938 | Helland | 2/2 |
| 2,196,124 | 4/1940 | Smith | 2/2 |
| 3,162,861 | 12/1964 | Gustafson | 2/2 |
| 3,174,155 | 3/1965 | Pitman | 2/411 |
| 3,189,917 | 6/1965 | Sims | 2/2 |
| 3,497,872 | 3/1970 | Mitchell | 2/2 |
| 3,855,631 | 12/1974 | Ettinger | 2/2 |
| 3,866,909 | 2/1975 | DeSantis | 2/2 |
| 4,151,613 | 5/1979 | Rhee | 2/2 |
| 4,453,271 | 6/1984 | Donzis | 2/2 |
| 4,694,505 | 9/1987 | Flosi et al. | 2/2 |
| 4,866,789 | 9/1989 | Dorm | 2/2 |
| 4,872,215 | 10/1989 | Sliger | 2/2 |
| 4,922,899 | 5/1990 | Graff et al. | 2/2 |
| 4,937,888 | 7/1990 | Straus | 2/411 |

FOREIGN PATENT DOCUMENTS

| | | | |
|---|---|---|---|
| 1460007 | 3/1969 | Fed. Rep. of Germany | 2/2 |
| 2225708 | 6/1990 | United Kingdom | 2/2 |

*Primary Examiner*—Clifford D. Crowder
*Assistant Examiner*—Michael A. Neas
*Attorney, Agent, or Firm*—John J. Posta, Jr.

[57] ABSTRACT

The improved self-defense practice assembly includes a protective padded helmet with face mask and rear and lateral depending walls adapted to transmit head shocks downwardly to the shoulder area of a wearer of the helmet. The assembly also includes a pair of shoulder pads upon which the shock-transmitting wall rests. The assembly also includes a hard shell padded groin and spine protector, with a testicle well, integral rear lateral buttock-covering wings and an integral upwardly extending spine plate. The components meet and overlap so as to fully protect the head and body of the wearer when playing the roll of a mugging assailant in a self-defense course. The helmet is a shell padded inside and out and webbed at the upper inside. The shoulder pads may include a padded horse collar on which the depending helmet wall rests. The groin and spine protector can be releasably connected to the shoulder pads by hook and pile fasteners straps and/or waist, leg and shoulder suspender straps.

8 Claims, 2 Drawing Sheets

SELF-DEFENSE PRACTICE ASSEMBLY

BACKGROUND OF THE INVENTION

1. Field of the Invention

The present invention generally relates to protective devices and more particularly to an improved protective device for use in self-defense classes to protect a would-be mugger or assailant.

2. Prior Art

In self-defense classes, it is conventional for a heavily padded person, usually a man, to act as a would-be mugger and assailant and to attack the class trainees one by one. The trainees are required to counter-attack, in most cases, as well as ward off the attack itself. In the process, the attacker is normally subjected to much kicking, punching, cuffing, tripping and other defensive and counter-attack measures. It is necessary to pad the attacker to protect against his injury and also to protect the arms and legs of the class trainee doing the counter-attacking during the practice session.

Although the head and groin areas of the attacker are protected by padding, heretofore little attention has been given to the potentially serious effects which can be caused by transmission of forces by blows to the head, for example, to the neck and torso of the attacker. Moreover, the groin, while padded, if kicked will react and transmit considerable force to adjacent parts of the body, including the abdomen, pubic bone, perineum and groin muscles with consequent possible injury to the attacker. Conventional groin protectors prevent the testicles from being crushed by blows, but not from being unpleasantly and dangerously jarred. Conventional torso protectors are unduly restrictive to bending or twisting movements, and to air movement needed for cooling by evaporation of sweat from the skin.

There remains a need for equipment affording better protection of would-be mugger assailants in self-defense classes in order to minimize the occurrence of injuries both to the attacker and to the class trainees encountering the attacker. Such equipment should be inexpensive, simple and durable, should not impede the attacker and should be easy to don and take off.

SUMMARY OF THE INVENTION

The improved self-defense practice assembly, helmet and groin and spine protector of the present invention satisfy all the foregoing needs. The assembly is substantially as set forth in the Abstract of the Disclosure, as are the helmet and groin and spine protection of the assembly. Thus, the assembly includes the novel padded helmet of the invention with face plate, separate eye and mouth openings and a rear and laterally depending shock-transmitting wall. The helmet releasably rests, via the depending wall, on a pair of conventional football shoulder pads. A chest plate, back plate and rib plates are flexibly attached to the shoulder pads. The chest and back plates overlap the abdominal and spinal extensions respectively of the groin protector. The novel groin and spine protector has a hard padded shell defining a bottom testicle well, a front portion covering the abdomen, integral rear lateral portions overlying the buttocks and an integral spine plate rising thereabove. The spine plate can be releasably connected to the shoulder pads by one or more VELCRO-type straps and/or shoulder suspenders. The groin and spine protector preferably also has suspenders and a waist strap and leg straps to help hold it in place.

A kick to the helmeted head of the attacker wearing the assembly is transmitted through the depending helmet walls of the shoulder pads and is dissipated. A kick to the solar plexus is transmitted to the ribs and lower stomach muscles or hips, depending on the overlap of the chest plate and abdominal extension of the groin protector. Similarly, a kick to the groin is transmitted and spread over the upper thighs, buttocks and pelvis. The testicle well is large enough so that the testicles are not jarred by contact of the protector when the protector is struck. Not only is the attacker fully protected against injury, but the cushion assembly parts prevent injury to the class trainer striking the attacker. The assembly is easy and simple to don and remove and the parts thereof act cooperatively for maximum effect.

Various other features of the improved assembly of the present invention, and the improved helmet and groin and spine protector thereof are set forth in the following detailed description and accompanying drawings.

DRAWINGS

DETAILED DESCRIPTION

FIGS. 1–8, 10 & 11

Figure 1:
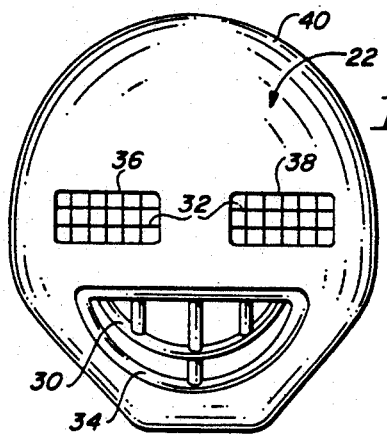
FIG. 1 is a schematic front elevation of a preferred embodiment of the improved helmet of the present invention.
Figure 2:
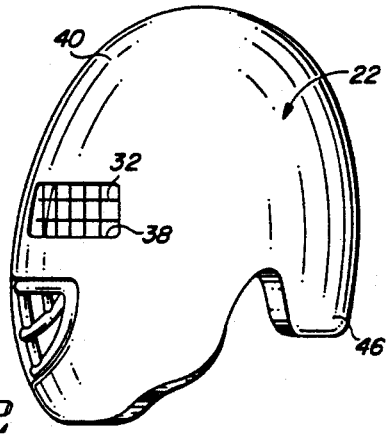
FIG. 2 is a schematic side elevation of the helmet of FIG. 1.
Figure 3:
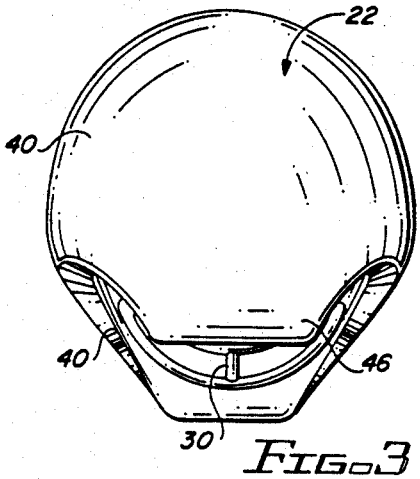
FIG. 3 is a schematic rear elevation of the helmet of FIG. 1.
Figure 4:
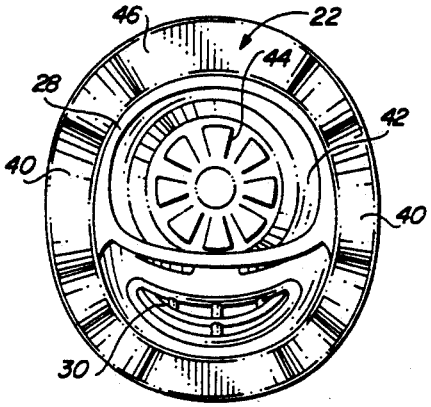
FIG. 4 is a schematic bottom plan view of the helmet of FIG. 1.
Figure 5:
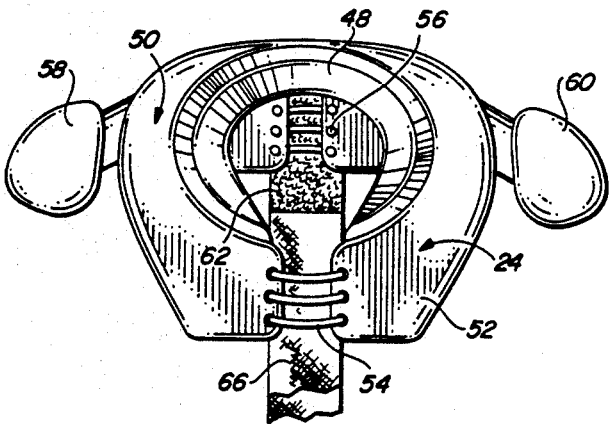
FIG. 5 is a schematic front perspective view of the shoulder pads of a preferred embodiment of the improved assembly of FIG. 1.
Figure 6:
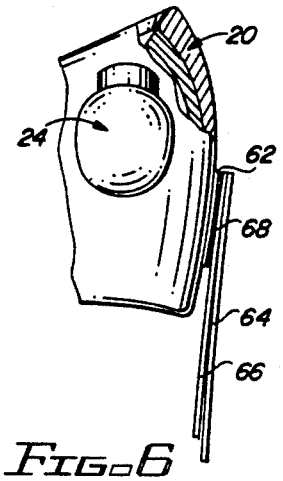
FIG. 6 is a fragmentary schematic side elevation of a preferred embodiment of the improved assembly of the present invention, showing the helmet thereof releasably seated on the shoulder pad thereof and the spine portion of the groin and spine protector thereof releasably connected to the shoulder pads thereof.
Figure 7:
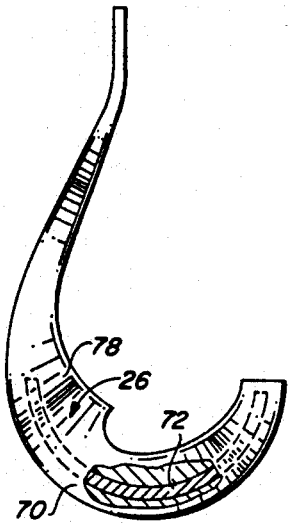
FIG. 7 is an enlarged schematic side elevation, partly broken away, of a preferred embodiment of the cup and spine portions of the improved groin and spine protector of the present invention.
Figure 8:
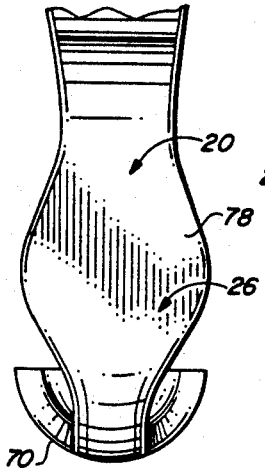
FIG. 8 is an enlarged fragmentary schematic rear view of the cup and spine portions of the groin and spine protector of FIG. 7.

Now referring more particularly to FIGS. 1–8, 10 and 11 of the drawings, a preferred embodiment of each of the improved assembly, helmet and groin and spine protector of the present invention is schematically depicted therein. Thus, assembly 20 is shown in FIG. 6 and comprises the helmet 22 of FIGS. 1, 2, 3, 4 and 6, along with the shoulder pads 50 of FIGS. 5 and 6 and the groin and spine protector 26 of FIGS. 6, 7, 8, 10 and 11.

Helmet 22 may comprise a steel or other metal or plastic cage or shell 28 bearing a bar face mask 30 showing through opening 34 in an outer layer 40 of soft resilient padding around shell 28. Openings 36 and 38 are covered with a flexible mesh 32 to protect the eyes. An inner layer 42 of soft resilient padding is inside shell 28 and a resilient webbing 44 is suspended in the top of shell 28, all to protect the wearer's head. Helmet 22 also includes a depending padded rear wall 46 which may rest on the top of a ring 48 of resilient padding or a so-called "horse collar" connected to the top of a pair of conventional football-type shoulder pads 50, or may rest directly on the shoulder pads 50.

Pads 50 include an externally and internally padded shell 52 adapted to wrap around the neck and upper torso of the wearer connected by lacing on straps at the front and back at points generally designated 54 and 56. It includes wings 58 and 60 adapted to protect the upper outer ends of the shoulders of the wearer. It can further include a depending tab 62 of conventional cloth VELCRO-type materials connected to the upper end of the rear of pads 50 above lace area 56 for releasable connection to the upper end 64 of spine plate 66 via a conventional cloth hook and pile fasteners tab 68 borne thereon, as more particularly shown in FIG. 6. A chest plate 53 is flexibly attached to the lower front of the shoulder pads by securing means 51. This consists of an externally and internally padded shell which covers the front of the wearer from the bottom of the sternum to the waist. The inner padding is cut out at 55 over the solar plexus region so that forces directed in the chest plate 53 are not transmitted to the sternum. A rib plate 57 consists of an externally and internally padded shell adapted to wrap around the lower ribs of the wearer. A back plate 61 is attached to the back of the shoulder pads 50. This plate of a flexible, resilient material is designed to overlap the spine plate 66 of the groin protector 26.

Figure 10:
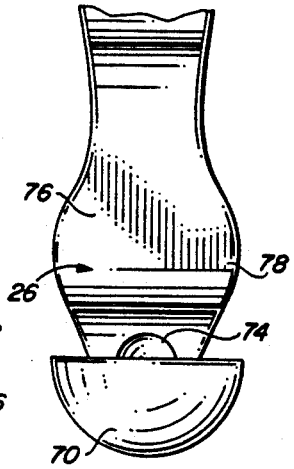
FIG. 10 is an enlarged fragmentary schematic front elevation of the protector of FIG. 7; and, FIG. 11 is an enlarged, fragmentary schematic top plan view of the groin and spine protector of FIG. 7.
Figure 11:
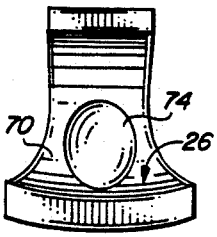

Spine plate 66 forms part of the third component of assembly 20, namely, the groin and spine protector 26. Protector 26 is generally ladle spaced with a rounded bottom cup portion 70 formed of a hard shell 72 padded externally and internally and defining a generally central testicle-receiving well 74 (FIGS. 10 and 11). Cup 70 rises in the front to protect the pubic bone and abdomen and rises in the rear to fan out into integral buttock-overlying lateral wing portions 76 and 78, in turn integrally connected with central spine plate 66 rising thereabove. The lower portion of plate 66 includes a protrusion 25 adapted to conform to the lower buttocks.

A kick to the front of cup 70 is transmitted all along protector 26 to be absorbed by the buttocks, thighs and pelvis so as to readily fully dissipate it. Shells 28, 52 and 72 can be of hard plastic, metal or the like for full protection. Padding layers such as 40 and 42, ring 48, etc., can be of synthetic or natural foamed rubber, foamed plastic, cellulose stuffing, or the like, for ample comfort as well as protection.

The chest plate 53 can freely slide over the front of the groin protector, allowing the wearer to bend, stretch and twist at the waist with ease. The chest plate 53 normally overlaps the groin protector 26 when the wearer is kicked in the front of the body, so that the entire front of the body is protected from direct impact.

Accordingly, assembly 20 is easy and rapid to don and take off and is fully protective. It is inexpensive, durable and usable in the fully assembled or partially assembled modes. Helmet 22 and pads 24 cooperate to absorb and distribute head shocks, while protector 26 and pads 24 cooperate to absorb and distribute blows to the torso, ribs, abdomen, groin, buttocks and spine. Protector 26 may have a stepped configuration for a better fit in the buttocks area. If desired, only the helmet 22 and pads 24 need by worn or, alternatively, pads 24 and protector 26.

FIG. 9

Figure 9:
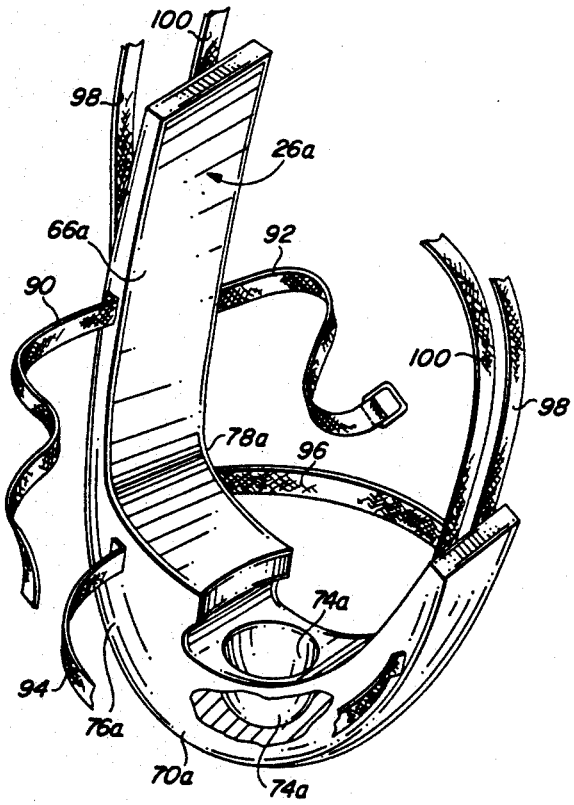
FIG. 9 is an enlarged schematic perspective view of a modified version of the improved groin and spine protector of the present invention.
Figure 12:
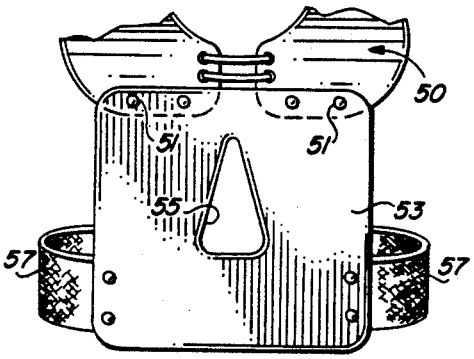
FIG. 12 is a front view of the chest plate.
Figure 13:
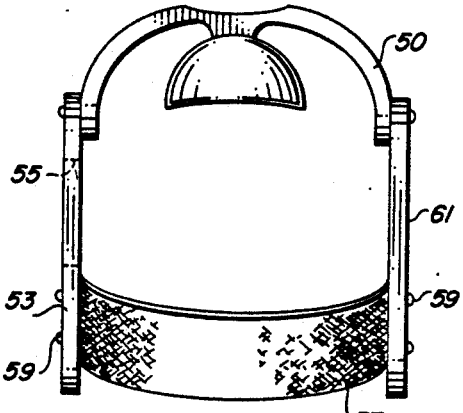
FIG. 13 is a side view of the protector with the rib plate in place.

A modified version of the improved groin and spine protector of the present invention is schematically depicted in FIG. 9. Thus, protector 26*a* is shown. Components thereof substantially identical to those of protector 26 bear the same numerals but are succeeded by the letter "a".

Protector 26*a* is identical to protector 26, except that it does not include any hook and pile fasteners tabs, but instead includes waist straps 90 and 92 stitched to the sides of spring plate 66*a*, leg straps or loops 94 and 96 stitched to the side of wings 76*a* and 78*a* and to cup 70*a*, and a pair of suspenders 98 and 100 stitched to the front top of cup 70*a* and to spine plate 66*a* and adapted to loop over shoulder pads 24 of assembly 20. Protector 26*a* can be fully substituted for protector 26 and in such instances tab 62 of pads 24 can be dispensed with. Protector 26*a* has the advantages of protector 26.

Various other modifications, changes, alterations and additions can be made in the improved assembly, helmet and groin and spine protector of the present invention. All such modifications, changes, alterations and additions as are within the scope of the appended claims form part of the present invention.

What is claimed is:

1. A groin and spine protector having a hard protective padded shell with a bottom testicle well and an integral rear buttocks overlying, shock-transmitting portion integral with an upwardly extending spine plate for transmitting shocks to the shell directly to the buttocks, and means for releasably connecting said groin and spine protector to a wearer.

2. The groin and spine protector of claim 1 wherein said spine plate includes a hook and pile fastener adapted to releasably connect said spine plate to a pair of shoulder pads.

3. The groin and spine protector of claim 1 wherein said releasable connecting means comprises a pair of spaced leg straps, a waist strap and a pair of spaced shoulder suspenders.

4. A self-defense practice assembly for protecting the groin area, comprising:

a) a curved padded shell adapted to conform to the groin area, b) said shell having a front extension adapted to cover and protect the pubic bone of the wearer, c) said shell having a testicle-receiving recess in a lower portion thereof; and, d) said shell having a rear portion adapted to cover and protect the buttocks area of a wearer and to transmit shocks directed to said lower portion directly into the buttocks for absorption thereof.

5. A self-defense practice assembly for protecting the groin area, comprising:

a) a curved padded shell adapted to conform to the groin area, b) said shell having a front extension adapted to cover and protect the pubic bone of the wearer, c) said shell having a testicle-receiving recess in a lower portion thereof; and, d) said shell having a rear portion adapted to cover and protect the buttocks area of a wearer and to transmit shocks directed to said lower portion directly into the lower portion of the buttocks for absorption thereof, and e) wherein said rear portion includes a protrusion adapted to underlie the buttocks so that shocks to the shell are directed into and absorbed by the buttocks.

6. The practice assembly of claim 4, including an extension of the rear portion of said shell which is adapted to overlie and protect the spine of a wearer.

7. The practice assembly of claim 6, including fastening means to secure said assembly to the wearer to anchor it in place.

8. The practice assembly of claim 7 wherein said fastening means includes leg straps, a waist strap and shoulder suspenders.

* * * * *